US007673463B2

(12) United States Patent
Tupis et al.

(10) Patent No.: US 7,673,463 B2
(45) Date of Patent: Mar. 9, 2010

(54) COOLING SYSTEM METHODS AND APPARATUS FOR A REFRIGERATION DEVICE

(75) Inventors: Jeffery A. Tupis, Taylorsville, KY (US); Martin Severance, Louisville, KY (US)

(73) Assignee: General Electric Company, Schenectady, NY (US)

( * ) Notice: Subject to any disclaimer, the term of this patent is extended or adjusted under 35 U.S.C. 154(b) by 821 days.

(21) Appl. No.: 11/240,210

(22) Filed: Sep. 30, 2005

(65) Prior Publication Data

US 2007/0074524 A1 Apr. 5, 2007

(51) Int. Cl.
*F25B 49/02* (2006.01)

(52) U.S. Cl. ..... 62/115; 62/196.4; 62/506

(58) Field of Classification Search ..... 62/197, 62/196.1, 498, 506, 196.4
See application file for complete search history.

(56) References Cited

U.S. PATENT DOCUMENTS

| | | | | |
|---|---|---|---|---|
| 2,497,028 | A * | 2/1950 | Kirkpatrick | 62/159 |
| 3,698,202 | A * | 10/1972 | Missimer | 62/114 |
| 4,086,780 | A | 5/1978 | Dienemann | |
| 4,158,294 | A | 6/1979 | Keeling, Jr. | |
| 4,718,245 | A * | 1/1988 | Van Steenburgh, Jr. | 62/196.4 |
| 4,831,835 | A * | 5/1989 | Beehler et al. | 62/196.1 |
| 5,190,095 | A | 3/1993 | Fujimoto et al. | |
| 5,487,277 | A | 1/1996 | Bessler | |
| 6,865,899 | B2 | 3/2005 | Nam et al. | |
| 7,021,069 | B2 | 4/2006 | Taira | |
| 2005/0279119 | A1 | 12/2005 | Sim et al. | |

* cited by examiner

*Primary Examiner*—William E Tapolcai
(74) *Attorney, Agent, or Firm*—George L. Rideout, Esq.; Armstrong Teasdale LLP

(57) ABSTRACT

A refrigerator includes a housing defining at least one chamber and a condenser system in which a refrigerant flows. The condenser system includes a condenser, a switching device, and a hot gas loop in flow communication with one another. The condenser system is configured to be in heat transfer relation with the chamber and the switching device is configured to allow the refrigerant to bypass the hot gas loop when a thermal demand of the refrigerator is met.

19 Claims, 3 Drawing Sheets

COOLING SYSTEM METHODS AND APPARATUS FOR A REFRIGERATION DEVICE

BACKGROUND OF THE INVENTION

This invention relates generally to refrigeration devices, and more particularly, to a cooling system method and apparatus for a refrigeration device to obtain maximum energy efficiency.

Recently, many countries around the world have established strict energy protection standards. Household refrigerators and freezers have been subject to some of these standards regarding the energy efficiency of these units.

Known refrigerators generally include a case defining at least one compartment for storage of food items, and a condenser/cooling system configured to provide a refrigeration result in the compartment, i.e., remove a certain amount of heat energy from the compartment to the outside environment. The condenser system is typically arranged in the case to transfer heat energy from the compartment to ambient environment outside the compartment. The transfer of this heat consumes energy.

While some of the improvement in energy efficiency has been obtained by improvement in the cabinet insulation, it has been found that improvements can be made in the refrigeration system itself. For example, a capillary tube and a hot gas loop are typically used in a condenser system of a refrigerator to improve cooling efficiency and reduce energy consumption. To improve heat exchange efficiency, increasing the lengths of the capillary tube and the hot gas loop has been adopted.

BRIEF DESCRIPTION OF THE INVENTION

In one aspect, a cooling system for a refrigerator is provided. The cooling system includes a refrigerant, a condenser assembly configured to provide heat energy exchange with the refrigerant, and a hot gas loop in communication with the condenser assembly. The cooling system also includes a switching device coupled to the condenser assembly and the hot gas loop. The switching device provides at least two selectable fluid paths in the cooling system. The switching device is configured to channel the refrigerant along one of the fluid paths based on a thermal demand of the refrigerator.

In another aspect, a refrigerator is provided. The refrigerator includes a housing defining at least one chamber and a condenser system in which a refrigerant flows. The condenser system includes a condenser, a switching device, and a hot gas loop in flow communication with one another. The condenser system is configured to be in heat transfer relation to the chamber and the switching device is configured to allow the refrigerant to bypass the hot gas loop when a thermal demand of the refrigerator is met.

In still another aspect, a method of assembling a refrigerator is provided. The method includes providing a housing with a refrigeration chamber and arranging a sealed cooling system within the housing to provide a heat transfer from the refrigeration chamber, wherein the sealed cooling system includes a condenser, a hot gas loop and a switching device and wherein a refrigerant is circulated within the cooling system. The method further includes coupling the switching device within the cooling system, wherein the switching device provides different fluid paths in the sealed cooling system. The switching device is configured to channel the refrigerant along a first fluid path that bypasses the hot gas loop and a second fluid path through the hot gas loop. The method also includes operatively coupling a controller to the switching device, wherein the controller is configured to control the operation of the switching device.

DETAILED DESCRIPTION OF THE INVENTION

Figure 1:
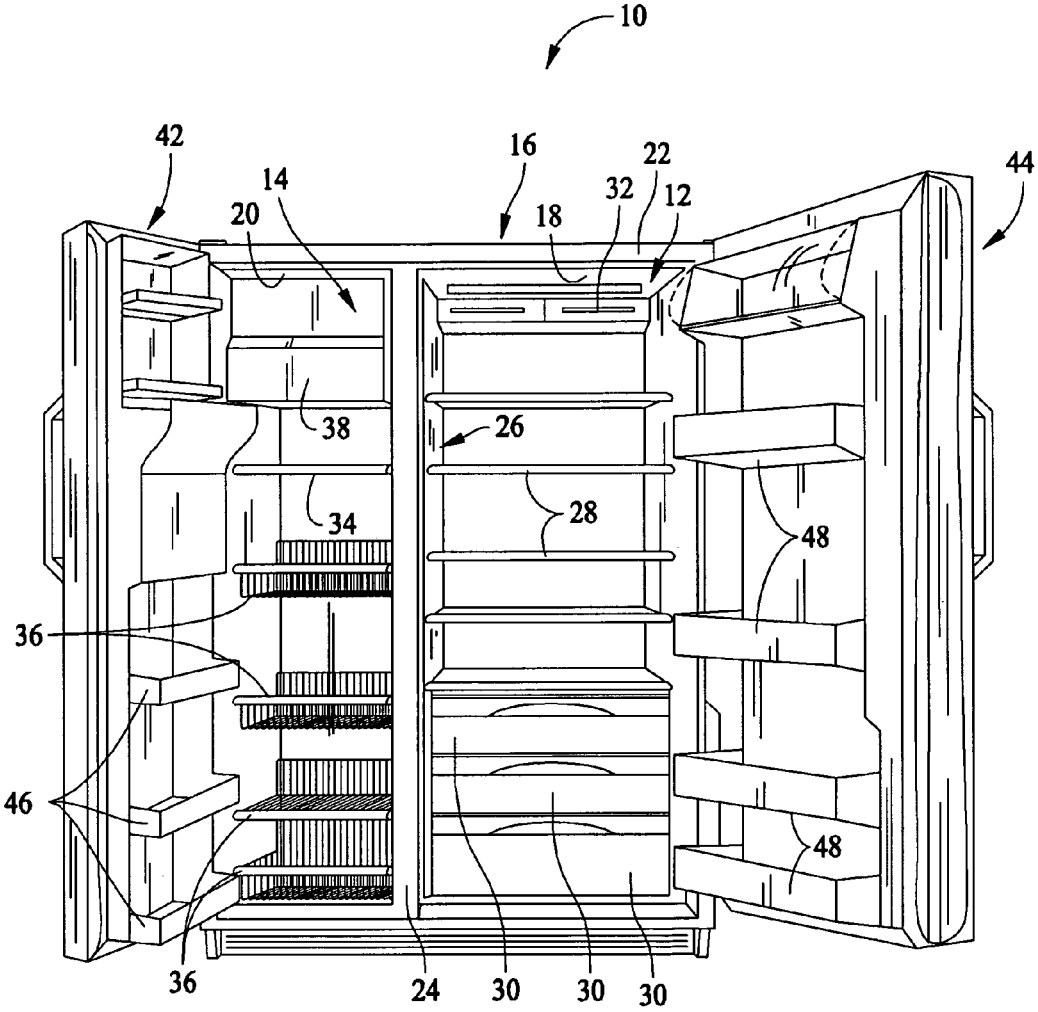
FIG. 1 illustrates an exemplary refrigerator in accordance with one embodiment of the present invention.

FIG. 1 illustrates an exemplary refrigeration appliance 10 in which the present invention may be practiced. In the embodiment described and illustrated herein, appliance 10 is a side-by-side refrigerator. It is recognized, however, that the benefits of the present invention are equally applicable to other types of refrigerators, freezers, and refrigeration appliances. Consequently, the description set forth herein is for illustrative purposes only and is not intended to limit the invention in any aspect.

Refrigerator 10 includes a fresh food storage compartment 12 and a freezer storage compartment 14. Freezer compartment 14 and fresh food compartment 12 are arranged side-by-side within an outer case 16 and defined by inner liners 18 and 20 therein. A space between case 16 and liners 18 and 20, and between liners 18 and 20, is filled with foamed-in-place insulation. Outer case 16 normally is formed by folding a sheet of a suitable material, such as pre-painted steel, into an inverted U-shape to form top and side walls of case 16. A bottom wall of case 16 normally is formed separately and attached to the case side walls and to a bottom frame that provides support for refrigerator 10. Inner liners 18 and 20 are molded from a suitable plastic material to form freezer compartment 14 and fresh food compartment 12, respectively. Alternatively, liners 18, 20 may be formed by bending and welding a sheet of a suitable metal, such as steel. The illustrative embodiment includes two separate liners 18, 20 as it is a relatively large capacity unit and separate liners add strength and are easier to maintain within manufacturing tolerances. In smaller refrigerators, a single liner is formed and a mullion spans between opposite sides of the liner to divide it into a freezer compartment and a fresh food compartment.

A breaker strip 22 extends between a case front flange and outer front edges of liners 18, 20. Breaker strip 22 is formed from a suitable resilient material, such as an extruded acrylo-butadiene-styrene based material (commonly referred to as ABS).

The insulation in the space between liners 18, 20 is covered by another strip of suitable resilient material, which also commonly is referred to as a mullion 24. In one embodiment, mullion 24 is formed of an extruded ABS material. Breaker strip 22 and mullion 24 form a front face, and extend completely around inner peripheral edges of case 16 and vertically between liners 18, 20. Mullion 24, insulation between compartments, and a spaced wall of liners separating compartments, sometimes are collectively referred to herein as a center mullion wall 26.

In addition, refrigerator 10 includes shelves 28 and slide-out storage drawers 30, sometimes referred to as storage pans, which normally are provided in fresh food compartment 12 to support items being stored therein.

Refrigerator 10 is controlled by a microprocessor (not shown) according to user preference via manipulation of a control interface 32 mounted in an upper region of fresh food storage compartment 12 and coupled to the microprocessor. A shelf 34 and wire baskets 36 are also provided in freezer compartment 14. In addition, an ice maker 38 may be provided in freezer compartment 14.

A freezer door 42 and a fresh food door 44 close access openings to fresh food and freezer compartments 12, 14, respectively. Each door 42, 44 is mounted to rotate about its outer vertical edge between an open position, as shown in FIG. 1, and a closed position (not shown) closing the associated storage compartment. Freezer door 42 includes a plurality of storage shelves 46, and fresh food door 44 includes a plurality of storage shelves 48.

Figure 2:
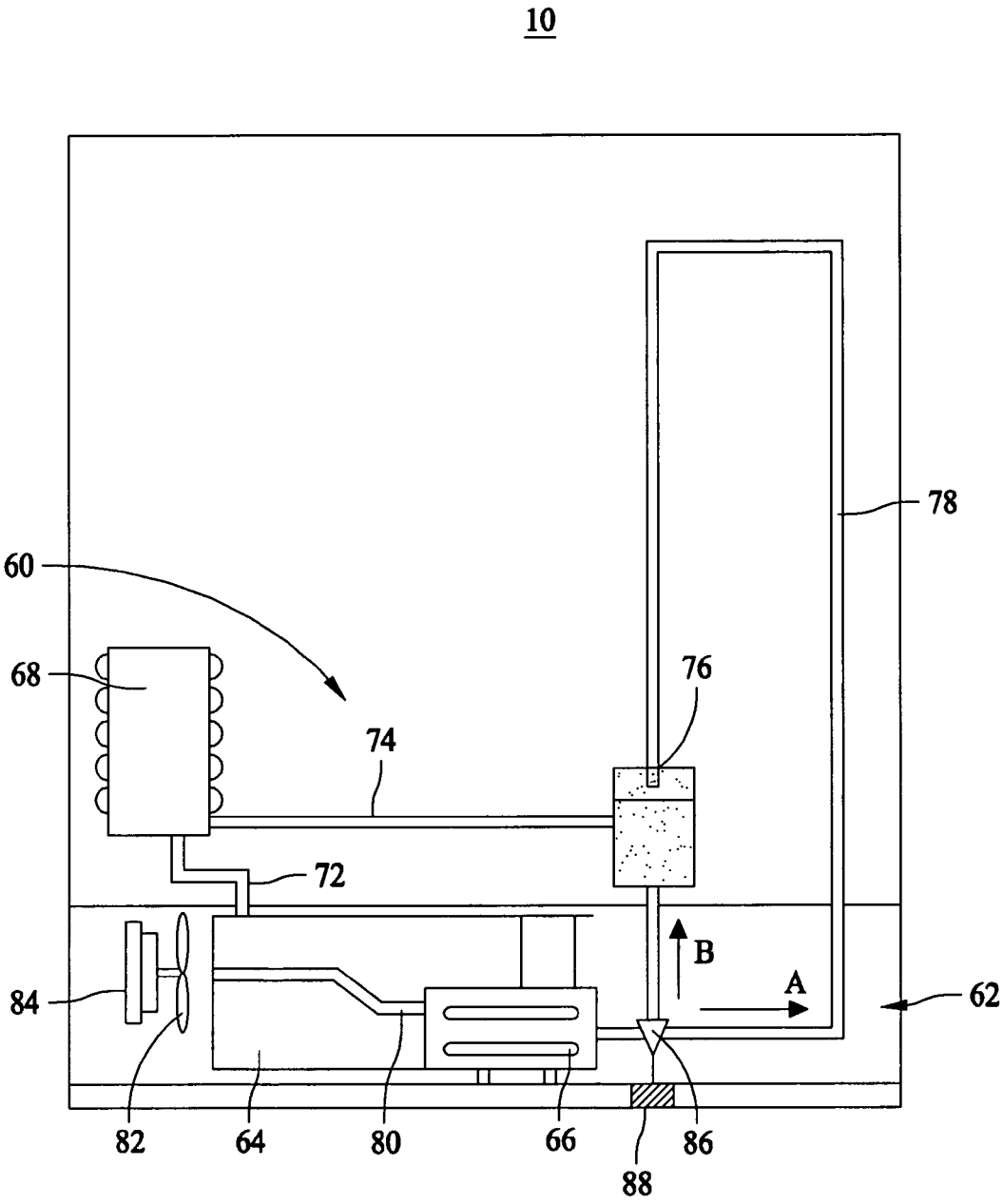
FIG. 2 is a rear elevational schematic view of the refrigerator shown in FIG. 1 including an exemplary sealed cooling system.

FIG. 2 is a rear elevational schematic view of refrigerator 10 (shown in FIG. 1) including an exemplary sealed cooling system 60. In accordance with known refrigerators, refrigerator 10 includes a machinery compartment 62 that at least partially contains components for executing a known vapor compression cycle for cooling air. The components include a compressor 64, a condenser 66, and an evaporator 68 connected in series and charged with a refrigerant. Evaporator 68 is a type of heat exchanger which transfers heat from air passing over the evaporator to a refrigerant flowing through evaporator 68 thereby causing the refrigerant to vaporize. As such, cooled air is produced and configured to refrigerate compartments 12, 14. Collectively, the vapor compression cycle components in a refrigeration circuit, associated fans, and associated compartments are sometimes referred to as a sealed cooling system operable to force cold air through refrigeration compartments 12, 14. In the exemplary embodiment, condenser 66 is arranged nearby the case flange of refrigerator 10.

Besides compressor 64, condenser 66, and evaporator 68, sealed cooling system 60 also includes a suction tube 72 connected between compressor 64 and evaporator 68, a capillary tube 74, a filter dryer 76, and a hot gas loop 78 connected serially. An inlet tube 80 is utilized to connect compressor 64 with condenser 66 which allows refrigerant to flow from compressor 64 to condenser 66. A fan 82 and a fan motor 84 connected therewith are received in machinery compartment 62 close to compressor 64. Fan 82 is driven by fan motor 84 to force air across outer surfaces of compressor 64 and condenser 66 to enhance heat transfer from compressor 64 to condenser 66, respectively, to ambient air. Capillary tube 74 is in fluid communication with filter dryer 76. Hot gas loop 78 is in communication with both filter dryer 76 and condenser 66.

In the exemplary embodiment, a three-way valve 86 is operatively connected between condenser 66 and hot gas loop 78, and is also operatively connected to filter dryer 76. As such, three-way valve 86 provides the refrigerant in sealed system 60 with at least two selectable fluid paths, as shown in arrows A and B. Particularly, three-way valve 86 may be operated to be switchable to channel refrigerant along one of the fluid paths based on a predetermined thermal demand of refrigerator 10. An electronic controller 88 is operatively coupled to three-way valve 86 to control the operation of the valve and also operatively coupled to the microprocessor (not shown) of the refrigerator 10. It is contemplated that three-way valve 86, in alternative embodiments, could be replaced by other switching devices which can achieve the same function of switching the refrigerant from one path to another without departing from the spirit of the present invention.

Figure 3:
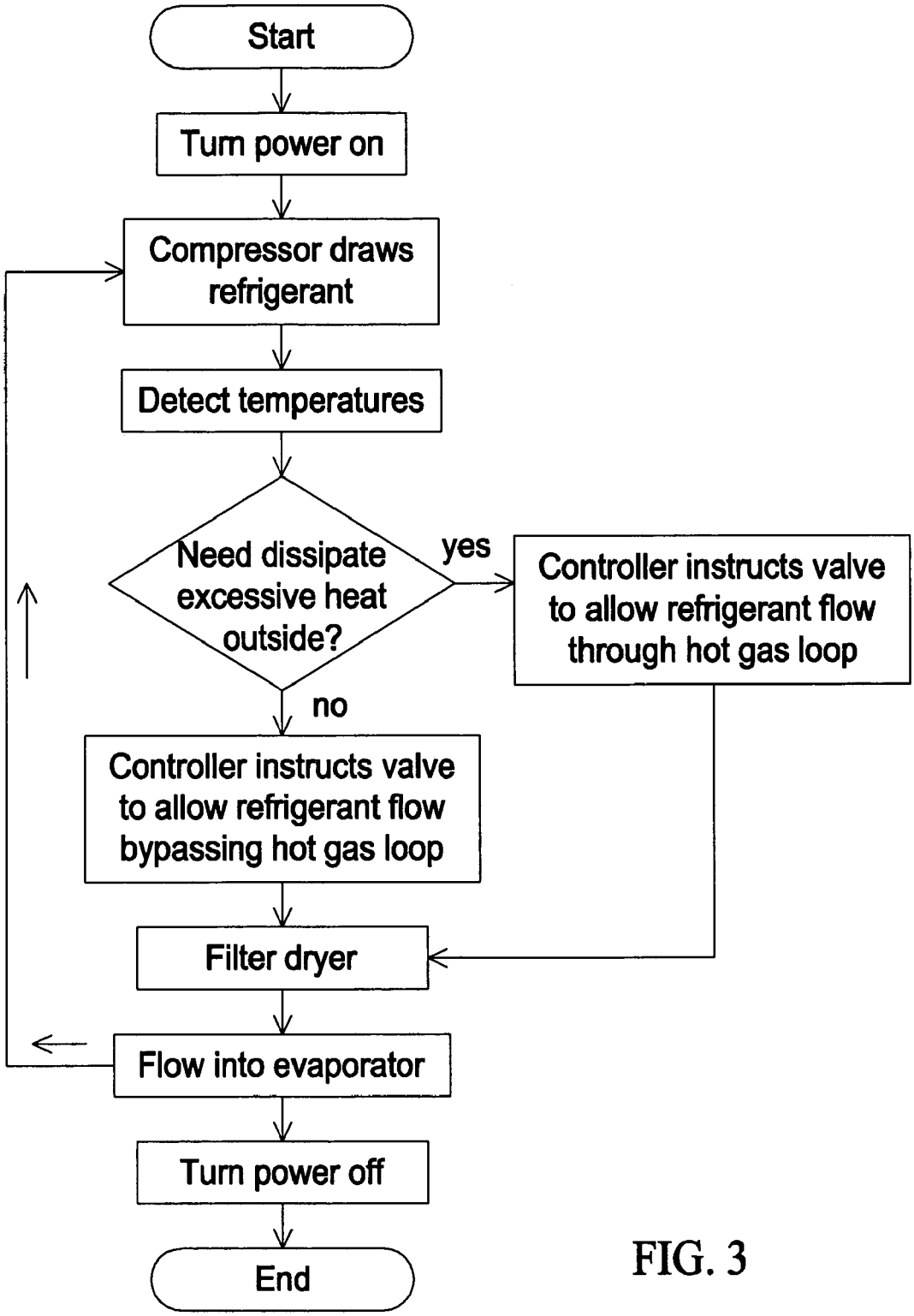
FIG. 3 is a schematic view of a flow chart showing the operation of the sealed cooling system.

FIG. 3 is a schematic view of a flow chart showing the operation of sealed cooling system 60. In operation, when the power is turned on by a user, refrigerator 10 begins to work. In other words, cooling system 60 starts to run to cool fresh food compartment 12 and freezer compartment 14. Compressor 64 is activated to draw refrigerant from evaporator 68 through suction tube 72 and discharge compressed refrigerant to condenser 66 via inlet tube 80. From condenser 66, refrigerant flows through three-way valve 86 and then to one of fluid paths A and B, based on detailed operating parameters, such as selected compartment temperature, operating temperature, ambient temperature, and others. During the process, detectors detect temperature factors, such as selected/operating temperature and ambient temperature. For instance, when the detectors detect that the selected temperature in fresh food compartment 12 is higher than the usual operating temperature, it is determined not to transfer excessive heat energy from fresh food compartment 12 to the outside environment through hot gas loop 78, since use of hot gas loop 78 would lead to loss of energy efficiency. A feedback signal is sent to controller 88 which controls three-way valve 86 to switch refrigerant to filter dryer 76 and bypass hot gas loop 78, as indicated by arrow B (shown in FIG. 2). If it is determined to dissipate excessive heat outside fresh food compartment 12, controller 88 controls three-way valve 86 to switch flow through hot gas loop 78, as indicated by arrow A (shown in FIG. 2).

Regardless of which path the refrigerant takes, the refrigerant enters filter dryer 76. The refrigerant continues to flow to capillary tube 74 from filter dryer 76 and then to evaporator 68 to transfer the heat energy from the compartments of refrigerator 10. Thus, a cooling circuit is formed with at least two selectable paths in refrigerator 10. The sealed system includes a hot gas loop and a three-way valve which allows refrigerant to bypass the hot gas loop during certain conditions. As such, energy efficiency is improved and energy is thus saved.

While the invention has been described in terms of various specific embodiments, those skilled in the art will recognize that the invention can be practiced with modification within the spirit and scope of the claims.

What is claimed is:

1. A cooling system for a refrigerator that includes a food compartment, the cooling system comprising:

a refrigerant;

a condenser assembly configured to provide heat energy exchange with said refrigerant;

a dryer in communication with said condenser assembly;

a hot gas loop configured to channel said refrigerant from said condenser assembly to said dryer;

at least one detector configured to detect at least one of a temperature within the food compartment and an ambient temperature; and a switching device operatively coupled between said condenser assembly and said hot gas loop, said switching device providing a first fluid path bypassing said hot gas loop to said dryer and a second fluid path through said hot gas loop to said dryer, said switching device configured to channel said refrigerant during operation of said cooling system along one of said first fluid path and said second fluid path based on at least one of the temperature within the food compartment and the ambient temperature detected by said at least one detector.

2. A cooling system in accordance with claim 1 wherein said switching device comprises a three-way valve configured to allow said refrigerant to bypass said hot gas loop.

3. A cooling system in accordance with claim 1 wherein said condenser assembly comprises an evaporator, a compressor, and a condenser connected serially.

4. A cooling system in accordance with claim 1 wherein said condenser assembly comprises a condenser, a compressor, a suction tube, an evaporator, a capillary tube, and said dryer connected serially.

5. A cooling system in accordance with claim 1 further comprising an electronic controller configured to control the operation of said switching device.

6. A cooling system in accordance with claim 1 further comprising a controller configured to control the operation of said switching device based on feedback from said at least one detector.

7. A refrigerator comprising:

a housing defining at least one chamber; and a condenser system in which a refrigerant flows, said condenser system comprising a condenser, a switching device, a dryer, and a hot gas loop in flow communication with one another, said condenser system further comprising at least one detector configured to detect at least one of a temperature within said at least one chamber and an ambient temperature, said condenser system configured to be in heat transfer relation with said at least one chamber, said switching device configured to provide a first fluid path bypassing said hot gas loop to said dryer and a second fluid path through said hot gas loop to said dryer, said switching device configured to channel said refrigerant during operation of the condenser system along one of said first fluid path and said second fluid path based on at least one of the temperature within said at least one chamber and the ambient temperature detected by said at least one detector.

8. A refrigerator in accordance with claim 7 wherein said switching device comprises a three-way valve.

9. A refrigerator in accordance with claim 7 further comprising an electronic controller operatively coupled to said switching device, said controller configured to bypass said hot gas loop with the refrigerant.

10. A refrigerator in accordance with claim 7 wherein said condenser system comprises an evaporator in heat transfer relation with said chamber, a compressor in fluid communication with said evaporator, and a condenser in fluid communication with said compressor.

11. A refrigerator in accordance with claim 7 wherein said condenser system comprises a condenser, a compressor, a suction tube, an evaporator, a capillary tube, and said dryer connected serially.

12. A refrigerator in accordance with claim 7 further comprising a controller configured to control the operation of said switching device based on feedback from said at least one detector.

13. A method of assembling a refrigerator, said method comprising:

providing a housing with a refrigeration chamber;

arranging a sealed cooling system at least partially within the housing to provide heat transfer from the refrigeration chamber, wherein the sealed cooling system includes a condenser, a dryer, a hot gas loop and a switching device, and wherein a refrigerant is circulated within the sealed cooling system;

coupling the switching device within the sealed cooling system, the switching device providing different fluid paths in the sealed cooling system, the switching device configured to channel the refrigerant during operation of the sealed cooling system along a first fluid path that bypasses the hot gas loop to the dryer and a second fluid path through the hot gas loop to the dryer;

coupling at least one detector within the refrigerator to detect at least one of a temperature within the refrigerator chamber and an ambient temperature; and operatively coupling a controller to the switching device, the controller configured to control the operation of the switching device.

14. A method of assembling a refrigerator in accordance with claim 13 wherein arranging a sealed cooling system within the housing comprises configuring an evaporator in the housing, coupling a compressor to the evaporator, and coupling a condenser to the compressor to provide fluid communication therebetween.

15. A method of assembling a refrigerator in accordance with claim 13 wherein arranging a sealed cooling system within the housing comprises configuring an evaporator in the housing, coupling a hot gas loop to the evaporator, coupling a compressor to the evaporator, and coupling a condenser to the compressor.

16. A method of assembling a refrigerator in accordance with claim 15 wherein coupling a switching device to the sealed cooling system comprises arranging a three-way valve between the condenser and the hot gas loop thereby allowing refrigerant to bypass the hot gas loop based on a predetermined thermal demand of the refrigerator.

17. A method of assembling a refrigerator in accordance with claim 15 wherein arranging a sealed cooling system within the housing further comprises coupling a capillary tube to the dryer and the evaporator.

18. A method of assembling a refrigerator in accordance with claim 13 wherein operatively coupling a controller to the switching device comprises electrically connecting a microprocessor with the switching device.

19. A method of assembling a refrigerator in accordance with claim 13 wherein coupling at least one detector within the refrigerator further comprises coupling the at least one detector to the controller, wherein the at least one detector is configured to provide feedback to the controller.

* * * * *